United States Patent [19]

Rakow

[11] 4,131,373

[45] Dec. 26, 1978

[54] TYPEWRITER RIBBON CARTRIDGE

[75] Inventor: Donald E. Rakow, Rockwall, Tex.

[73] Assignee: Liquid Paper Corporation, Dallas, Tex.

[21] Appl. No.: 805,348

[22] Filed: Jun. 10, 1977

[51] Int. Cl.[2] ..... B41J 33/14

[52] U.S. Cl. ..... 400/208

[58] Field of Search ..... 197/151, 175

[56] References Cited

U.S. PATENT DOCUMENTS

| | | | |
|---|---|---|---|
| 1,871,236 | 8/1932 | Proctor | 196/151 UX |
| 2,667,257 | 1/1954 | Hurtado | 197/175 |
| 2,930,470 | 3/1960 | Roller et al. | 197/151 |
| 3,075,627 | 1/1963 | Kuckhoff | 197/151 |
| 3,093,231 | 6/1963 | Landgraf | 197/151 X |
| 3,272,304 | 9/1966 | Morelli | 197/151 |
| 3,380,581 | 4/1968 | Landgraf | 197/151 X |
| 3,425,532 | 2/1969 | Dannatt | 197/151 |
| 3,618,869 | 11/1971 | Cialone et al. | 197/151 X |
| 3,877,561 | 4/1975 | Guerrini et al. | 197/151 |
| 3,889,795 | 6/1975 | Garberi et al. | 197/151 |

*Primary Examiner*—Ernest T. Wright, Jr.

*Attorney, Agent, or Firm*—Richards, Harris & Medlock

[57] ABSTRACT

A typewriter ribbon cartridge includes a housing having an upper wall with side walls extending therefrom. The upper wall is formed with two spaced apertures therein. A takeup spindle is fitted with its first end receivable in one aperture in the upper wall, and a ribbon supply spool is fitted with its first end supported for rotation in the second aperture. A supply spool platform is attached to the end of the supply spool remote from the upper wall and rotates with the supply spool. Typewriter ribbon is connected between the supply spool and the takeup spindle with a supply of ribbon wound onto the supply spool. A cover is supported from the side walls extending from the housing, and receives the second end of the takeup spindle such that the spindle is rotatively supported between the cover and the upper wall of the housing.

9 Claims, 8 Drawing Figures

TYPEWRITER RIBBON CARTRIDGE

BACKGROUND OF THE INVENTION

1. Field of the Invention

This invention relates to a typewriter ribbon cartridge and more particularly to a ribbon cartridge designed to facilitate the advancement of typewriter ribbon during typing.

2. Prior Art

Many typewriters are produced today to accept typewriter ribbon enclosed in a cartridge. Typewriter ribbon cartridges generally include a casing which supports the upper and lower ends of a ribbon receiving spindle and, at a spaced location, the upper and lower ends of a ribbon supply spool. Ribbon is loaded on the supply spool, and during operation of the typewriter, a feed mechanism advances the ribbon from the supply spool to the receiving spindle.

The typewriter ribbon cartridge units presently used, an example being illustrated in U.S. Pat. No. 3,731,781, to Caudill, et al., issued May 8, 1973, have been lacking in a number of respects. Many of these cartridges use a totally enclosed housing which supports the upper and lower ends of the ribbon receiving spindle and the upper and lower ends of the ribbon supply spool. This is generally accomplished by providing a housing having an upper plate with downwardly extending sides which receive a lower cover. Both the ribbon takeup spindle and supply spool are supported between the upper plate and the lower cover.

This arrangement has been satisfactory in some respects. However, both the upper plate and lower cover are stationary relative to the rotative movement of both the takeup spindle and the supply spool. As a result, the bottom edge of the ribbon is continuously drawn over the stationary lower cover as the ribbon is fed from the supply spool to the takeup spindle. This contact between the ribbon and the lower cover of the conventional ribbon typewriter cartridges results in drag on the ribbon causing the ribbon to stretch or bind up during operation of the typewriter. Further, this arrangement prevents the uniform feeding of the ribbon and in some cases may completely restrict the feeding of the ribbon from the supply spool to the takeup spindle.

This conventional arrangement also requires substantial alignment of the ribbon on the supply spool as the ribbon is wound on the spool. If the ribbon is wound too low on the spool, when the supply spool is assembled into the cartridge the ribbon will be in binding contact with the lower cover. When this occurs, substantial drag may result between the ribbon and the cover and prevent the relative movement between the ribbon and the cover necessary for the ribbon to advance during typing.

Further, in the conventional typewriter cartridge design, the ribbon is wound onto the supply spool and then must be assembled into the housing. During assembly, the ribbon is fully exposed and may be easily damaged or dislocated from the spool.

SUMMARY OF THE INVENTION

The present invention provides a typewriter ribbon cartridge which eliminates many of the problems heretofore experienced by the cartridges now in use. In a preferred embodiment of the invention, the typewriter ribbon cartridge includes a housing having an upper wall with side walls extending therefrom. The upper wall is formed with two spaced apertures therein. A takeup spindle is fitted with its first end receivable in one aperture in the upper wall, and a ribbon supply spool is fitted with its first end supported for rotation in the second aperture. A supply spool platform is attached to the end of the supply spool remote from the upper wall and rotates with the supply spool. Typewriter ribbon is connected between the supply spool and the takeup spindle with a supply of ribbon wound onto the supply spool. The ribbon connection is made such that by rotating the takeup spindle, ribbon is unwound from the supply spool onto the takeup spindle. A cover is supported from the side walls extending from the housing. This cover receives the second end of the takeup spindle such that the spindle is rotatively supported between the cover and the upper wall of the housing.

Of significant importance to the invention is the structure whereby the supply spool platform is attached to and rotates with the ribbon supply spool. Because the platform rotates with the supply spool, no drag is experienced between the lower edge of the ribbon and the surrounding structure of the ribbon cartridge as ribbon is transferred from the supply spool to the takeup spindle. Further, the supply spool platform facilitates the winding of a supply of ribbon onto the supply spool by preventing ribbon from being wound below the bottom end of the spool. Moreover, once ribbon has been loaded onto the supply spool, the platform provides protection as well as facilitates handling of the spool prior to and during assembly with the other cartridge components.

In accordance with another embodiment of the invention, the end of the ribbon supply spool fitted within the upper wall of the housing is formed with a circumferential groove immediately below an outwardly flared end. The flared end is slightly larger than the aperture in the upper wall in which the end is received such that the flared end may be forced through the aperture of the upper wall. With the flared end protruding through the aperture in the upper wall, the supply spool is retained in position relative to the housing with the circumferential groove maintained in the mouth of the aperture.

In accordance with still another embodiment of the invention, the takeup spindle is formed with an end receivable through a second aperture in the upper wall of the housing such that a circumferential groove formed immediately below the end may be positioned in the mouth of the aperture in the upper wall. In this way, the takeup spindle is positioned during the assembly of the lower cover to the housing while being free to rotate relative to the upper wall.

In still another embodiment of the invention, locating pins extend from the housing and are receivable by the lower cover. The lower cover is thereby accurately positioned relative to the housing prior to being permanently affixed thereto by welding or other suitable means.

Therefore, the present invention provides a typewriter ribbon cartridge having a ribbon takeup spindle and a ribbon supply spool rotatably supported in a cartridge housing. The ribbon supply spool includes a shaft supported for rotation from the upper wall of the housing and a platform attached to the end of the shaft remote from the upper wall. The supply spool platform rotates with the shaft as ribbon moves from the supply spool to the takeup spindle, thereby eliminating any interference or drag which might result from contact between the lower edge of the ribbon and portions of the housing. Moreover, the support platform of the supply spool facilitates the winding of ribbon onto the supply spool and the handling of the ribbon and spool prior to and during engagement of the spool into the cartridge housing.

DESCRIPTION OF THE DRAWING

For a more complete understanding of the present invention, and for further details and advantages thereof, reference is now made to the following description taken in conjunction with the accompanying drawing in which.

DESCRIPTION OF THE PREFERRED EMBODIMENT

Figure 1:
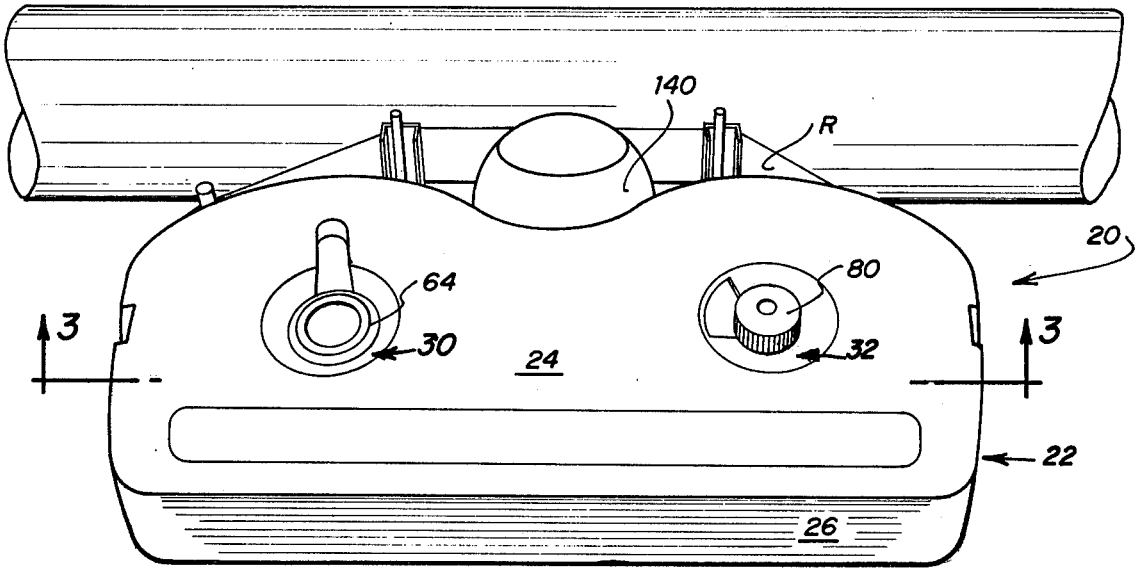
FIG. 1 is a perspective view of a typewritter ribbon cartridge embodying the present invention.
Figure 2:
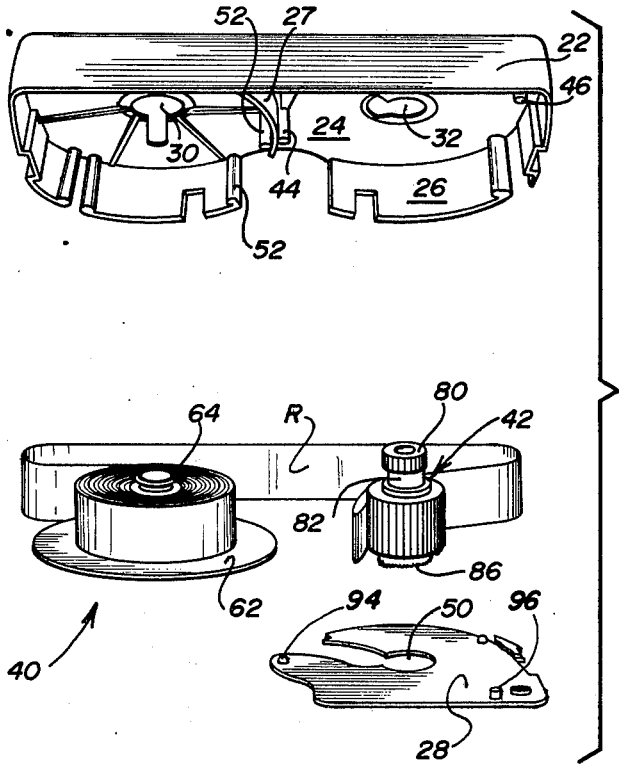
FIG. 2 is an exploded view of a typewritter ribbon cartridge embodying the present invention.

FIGS. 1 and 2 illustrate perspective and exploded views respectively of a typewritter ribbon cartridge embodying the present invention. Referring specifically to these figures, a ribbon cartridge 20 includes a casing 22 formed with an upper wall 24, side and interior walls 26 and 27, respectively, and a lower cover plate 28. Side walls 26 and interior wall 27 extend downwardly from and are integral with upper wall 24. The upper wall 24 has apertures 30 and 32 formed therein. A ribbon supply spool unit 40 is rotatably received within aperture 30 such that spool unit 40 rotates freely relative to casing 22. Similarly, a ribbon takeup spindle 42 is rotatably receivable within aperture 32 such that spindle 42 may rotate freely relative to casing 22.

Figure 3:
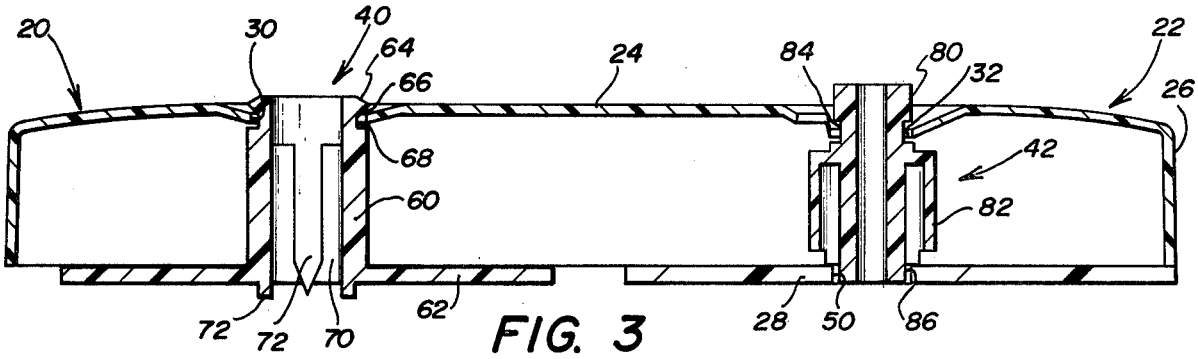
FIG. 3 is a vertical section taken along line 3—3 of FIG. 1.

Referring now to FIG. 3, casing 22 has an upper wall 24, side walls 26 and an interior wall 27 extending substantially perpendicular therefrom. Two locating pins 44 and 46 extend from casing 22 (FIG. 2). The ends of locating pins 44 and 46 remote from upper wall 24 are formed to receive protrusions or nipples 94 and 96, respectively from cover plate 28 and thereby serve to locate cover plate 28 in its appropriate position relative to casing 22. Cover plate 28 is also formed with an aperture 50 and receives the end of takeup spindle 42 remote from its engagement into upper wall 24. A plurality of projections 52 extend from and are parallel to both side walls 26 and interior wall 27.

Supply spool unit 40 includes a cylindrical shaft 60 integrally joined to a lower circular platform 62. The upper end of shaft 60 is formed with an outwardly flared lip 64 and a circumferential groove 66 formed immediately below flared lip 64. Aperture 30 in upper wall 24 is sized to permit an interference passage of flared lip 64 of shaft 60 therethrough. In this way, supply spool unit 40 is rotatably received in upper wall 24 by the engagement of lip 64 through aperture 30 such that circumferential groove 66 is positioned in line with aperture 30. An annular platform 68 is formed in shaft 60 by circumferential groove 66. Because the diameter of shaft 60 is larger than the diameter of aperture 30, platform 68 engages upper wall 24 as supply spool unit 40 is moved upwardly toward wall 24. Thus, supply unit 40 is maintained in a predetermined position relative to upper wall 24 but is free to rotate relative to casing 22.

Shaft 60 has an internal bore 70 formed therein, and spike ribs 72 protrude inwardly from the wall of bore 70. Ribs 72 engage the feed mechanism of the typewriter in which the cartridge 20 is used during the operation of the typewriter.

Support spool platform 62 is circular, and preferably is formed integral with shaft 60. Alternatively, platform 62 and shaft 60 may be formed separately and joined as a single unit by any suitable means. Platform 62 extends substantially perpendicular from shaft 60 adjacent the end of shaft 60 remote from the connection of shaft 60 to upper wall 24. Takeup spindle 42 includes a head 80 attached to a shaft portion 82. Head 80 is formed with an outer circumference only slightly smaller than the diameter of aperture 32. A circumferential groove 84 is formed immediately below head 80 with the circumference of takeup spindle 42 immediately below aperture 84 being slightly larger than aperture 32. With this construction, head 80 may be inserted through aperture 32 to a position where annular groove 84 is positioned adjacent aperture 32. The end of shaft portion 82 remote from head 80 is formed with a smaller diameter section 86 which is receivable in aperture 50 of cover plate 28. As will be discussed in greater detail, cover plate 28 is aligned with and attached to side walls 26 of casing 22. Upon assemblage of cover plate 28 on casing 22, takeup spindle 42 is supported for rotation at its upper end in aperture 32 and at its lower end in aperture 50.

As is illustrated in FIG. 3, there is a relatively loose fit between the portions of takeup spindle 42 positioned within apertures 32 and aperture 50. This relationship may be changed according to the specific needs of each case. However, it has been found that a relatively loose fit is acceptable for the proper operation of typewriter ribbon cartridge 20 of the present invention. In part, this is due to the fact that takeup spindle 42 engages and is supported by drive mechanism of the typewriter in which cartridge 20 is used. Likewise, there is a relatively loose fit between shaft 60 of ribbon supply spool unit 40 and aperture 30 in upper wall 24. Again, supply spool unit 40 engages and is partially supported by the drive mechanism of the typewriter in which cartridge 20 is used and a relatively loose fit between supply spool unit 40 and cartridge casing 22 is acceptable.

Figure 4:
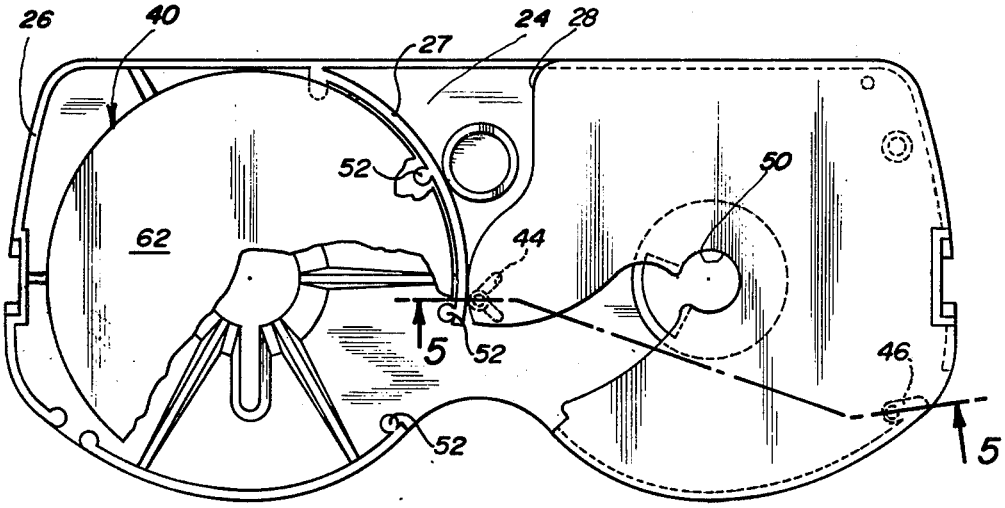
FIG. 4 is a bottom view of the typewritter ribbon cartridge of the present invention.

The bottom view of cartridge 20 illustrated in FIG. 4 shows that supply spool platform 62 does not overlap side walls 26 extending from upper wall 24, but does pass below projections 52 which extend from side walls 26 and interior wall 27. The presence of projections 52 from side walls 26 and interior wall 27 prevents ribbon R loaded on supply spool unit 40 from unwinding and moving off the platform 62. Ribbon R is wound onto shaft 60 to a diameter slightly less than that defined by the position of projections 52. In this way, projections 52 do not contact ribbon R unless ribbon R becomes unwound from shaft 60 or otherwise moves to the outer circumference of platform 62. In this arrangement, platform 62 necessarily has a diameter larger than the diameter to which ribbon R is normally loaded onto shaft 60. This assures complete support of ribbon R. Therefore, the present arrangement provides a rotatable ribbon supply platform 62 which minimizes or eliminates possible interference between platform 62 and side wall 26 of casing 22.

Figure 5:
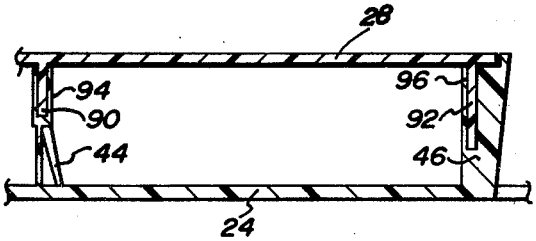
FIG. 5 is a vertical transverse section taken through the locating pins along line 5—5 of FIG. 4.

FIG. 5 illustrates a vertical section view through locating pins 44 and 46. As is shown in FIG. 5, these locating pins 44 and 46 extend downwardly from upper wall 24 of casing 22 and are formed with a receiving aperture 90 and 92 therein, respectively. Cover plate 28 is formed with locating nipples 94 and 96 which are aligned to engage apertures 90 and 92 of locating pins 44 and 46 to position cover plate 28 relative to side walls 26 of casing 22. In this way, cover plate 28 is appropriately located relative to side walls 26 prior to and during the process of permanently joining cover plate 28 to side walls 26.

Prior to the assemblage of typewriter ribbon cartridges 20, ribbon R is first loaded onto supply spool unit 40. The present invention provides a significant advantage in this step of assemblying a typewriter ribbon cartridge 20. Because the supply spool platform 62 is attached to one end of supply spool shaft 60, controlling the positioning of ribbon R on shaft 60 is not nearly as critical as in prior units. In the present invention, platform 62 forms a boundary below which ribbon R cannot be wound and prevents the possibility of ribbon R later interfering or contacting lower cover plate 28 of ribbon cartridge 20. However, it is not critical in the practice of the present invention that the lower edge of ribbon R be in contact with the surface of platform 62. The lower edge of ribbon R may indeed be positioned at some point slightly above platform 62.

In prior art units, the positioning of the ribbon on the supply shaft is critical because ribbon loaded too low on the shaft will drag against the lower cover used to support the lower end of the supply shaft. In this invention, this possibility is eliminated because loading of ribbon R too low on supply spool unit 40 is prevented by the existence of the platform 62.

Further, once ribbon R has been loaded onto supply spool unit 40, platform 62 provides protection as well as facilitates the handling of wound spool unit 40 prior to and during assembly. In the prior art units where there is no lower platform attached to the supply spool shaft, the ribbon is susceptible to damage and also may be bent or distorted such that upon assembly of the cartridge casing, the ribbon binds against or is in frictional contact with the surrounding structure.

In the present invention, after ribbon R has been loaded onto supply spool unit 40, the end of shaft 60 remote from platform 62 is engaged through aperture 30 of upper wall 24. As discussed earlier, the flared lip 64 is engaged through aperture 30. Lip 64 is sufficiently larger than aperture 30 to prevent the disclocation of shaft 60 back through aperture 30 but is sized such that lip 64 may be forced through aperture 30 upon assembly. In this position, supply unit 40 is free to rotate relative to casing 22 but is retained in position relative to casing 22 by the simple engagement of the upper end of shaft 60 through aperture 30. There is no lower cover for the supply spool portion of casing 22, as the platform 62 serves this function though being rotatable with shaft 60.

The assembly of cartridge 20 is completed by inserting head 80 to takeup spindle 42 through aperture 32 in upper wall 24. Cover plate 28 is then positioned relative to casing 22 by engaging nipples 94 and 96 into apertures 90 and 92 of locating pins 44 and 46, respectively. Simultaneously therewith, the lower section 86 of takeup spindle 42 is positioned in aperture 50 of cover plate 28. Cover plate 28 is retained in position against side walls 26 by any suitable means. In accordance with one embodiment of the invention, cover plate 28 is sonic welded to side walls 26.

The free end of the inked ribbon R from supply spool unit 40 is threaded outside casing 22 as illustrated in FIG. 1 and back into casing 22 where it is attached to takeup spindle 42.

In operation of a typewriter employing cartridge 20 of the present invention, cartridge 20 is first engaged on the advance mechanism of the typewriter and ribbon R threaded appropriately relative to the typing element 140 (FIG. 1). As the typewriter is operated, the spindle 42 is rotated to advance ribbon R from supply spool unit 40 to takeup spindle 42. It may now be appreciated that in the present invention, as ribbon R is unloaded from supply spool unit 40 there is no possibility of drag or other interference between the lower edge of ribbon R and the surrounding casing 22 because supply spool platform 62 rotates with ribbon R. By eliminating the possibility of drag or interference between ribbon R and casing 22, the present invention eliminates the possibility of ribbon R being so tightly engaged against the casing 22 that ribbon R will not advance in reponse to the rotation of takeup spindle 42. When this occurs in conventional cartridges, the ribbon will either be stretched until broken or until the ribbon becomes freed. In either event, the ribbon is substantially distorted and the operation of the typewriter is impaired.

Figure 6:
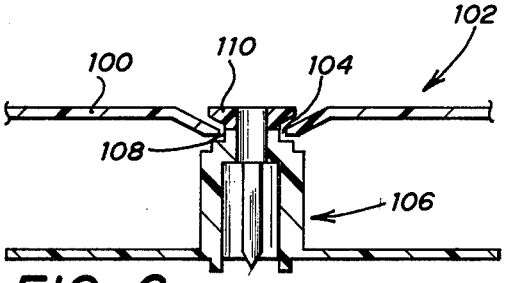
FIG. 6 is an alternative embodiment of the engagement of the supply spool shaft head with the cartridge housing upper wall.

FIG. 6 illustrates an alternative embodiment of the structure for retaining the upper end of supply spool shaft 60 in engagement with the upper wall of the cartridge casing. In this embodiment, the upper wall 100 of a cartridge casing 102 has an aperture 104 formed therein. A supply spool shaft 106 is formed with an upper extending cylindrical section 108 which may be received through aperture 104. A cap member 110 contoured to mate with the contour of upper wall 100 is attached to the upper surface of cylindrical section 108. This attachment may be by sonic welding or other appropriate means.

Figure 7:
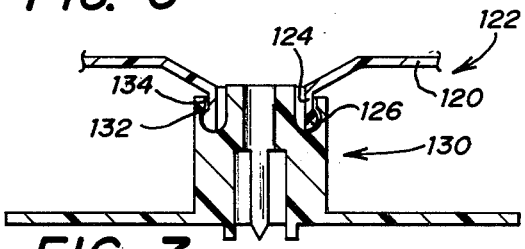
FIG. 7 is another alternative embodiment of the engagement of the supply spool shaft head with the cartridge housing upper wall.

In the alternative embodiment illustrated in FIG. 7, the upper wall 120 of a cartridge casing 122 has a downwardly extending cylindrical section 124 with an outward facing circular bead 126. A supply spool shaft 130 is formed with a cylindrical extension 132 having an inwardly directed bead 134 formed thereon. The innermost diameter of bead 134 is slightly smaller than the outermost diameter of bead 126. However, inwardly directed bead 134 may be engaged over outwardly directed bead 126 such that supply spool shaft 130 is supported from upper wall 120. The assembly of the supply spool shaft 130 into the interlocking position illustrated in FIG. 7 with the upper wall 120 may be accomplished by merely forcing the annular bead 134 past the outwardly directed bead 126 supported from upper wall 120. The interlocking fit is sufficient to restrain the downward movement of supply spool shaft 130 relative to the upper wall 120 in normal operation of the ribbon cartridge.

Therefore, the primary embodiment of the present invention illustrated in FIGS. 1–5 and the alternative embodiments illustrated in FIGS. 6 and 7 provide a typewritter ribbon cartridge including a housing supporting a supply spool from which ribbon is supplied to a takeup spindle. The supply spool consists of a shaft freely rotatable relative to and supported from the cartridge casing and a platform attached to the shaft remote from the point of support of the shaft from the casing. Because the platform moves with the supply spool shaft, the structure of the present invention eliminates any possibility of drag or interference between the ribbon as it is unwound from the supply spool onto the takeup spindle.

The present invention not only eliminates the possibility of drag or binding between the ribbon and the surround casing as is found in prior art ribbon cartridges, but also greatly reduces problems associated with loading ribbon onto the supply spool as well as handling and assembly of the supply spool into the cartridge casing. Because the supply spool unit has both a shaft and a platform attached thereto, the position on the shaft on which the ribbon is loaded is not so critical as the platform prevents the loading of the ribbon below the plane formed by the platform upper surface. In prior art devices, no such guide exists and ribbon loaded too low on the shaft will necessarily be in binding contact with the base cover of the ribbon cartridge.

Moreover, in the present invention, once ribbon is loaded onto the supply spool unit, the ribbon is protected from damage or dislocation relative to the supply spool shaft by the supply spool platform. Therefore, prior to and during the assembly of the supply spool unit into the casing, likelihood of damage or distortion of ribbon R is substantially reduced.

Figure 8:
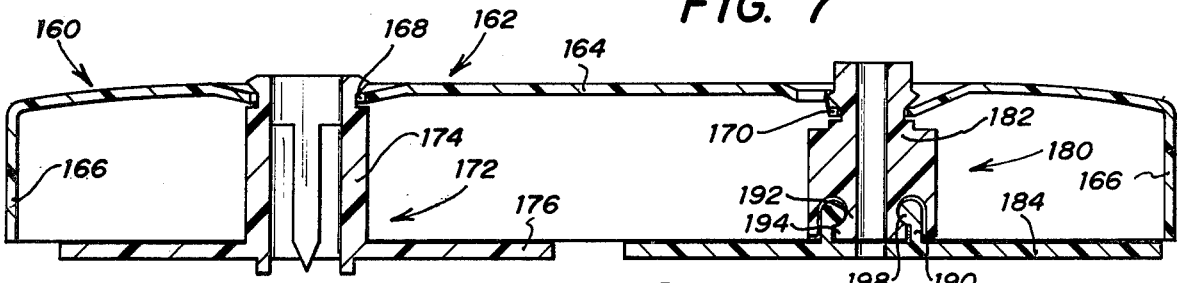
FIG. 8 is a vertical section of an alternative embodiment of the present invention wherein both the supply spool and takeup spindle have platforms supported therefrom.

FIG. 8 illustrates an alternative embodiment of the present invention wherein the takeup unit has a floating platform which is suspended from the casing by the takeup spindle. In the embodiment illustrated in FIG. 8, the cartridge 160 includes a casing 162 with an upper wall 164 and side walls 166 extending downwardly therefrom. The upper wall 164 has apertures 168 and 170 formed therein. The supply spool unit 172 includes a supply spool shaft 174 and a platform 176 attached to the lower end of shaft 174. The upper end of shaft 174 is adapted to be received into aperture 168. The particular means of engagement of the upper end of shaft 174 into aperture 168 may be any of those discussed and illustrated with respect to the embodiment of FIGS. 1–5 or the alternative embodiments illustrated in FIGS. 6 and 7.

A takeup reel unit 180 includes a shaft 182 and a platform 184 supported therefrom. The upper end of shaft 182 is formed to be received into aperture 170 of casing 162. This engagement may also be one of those illustrated in the preferred embodiment of FIGS. 1–5 or any one of the alternative embodiments illustrated in FIGS. 6 or 7. The lower end of shaft 182 is rotatably engaged to an upwardly extending cylindrical section 190. In a preferred embodiment, the design of this arrangement is identical to that illustrated in FIG. 7 and used to attach the upper end of supply spool shaft 130 to the upper wall 120 of casing 122. Thus, supply spool shaft 182 is formed with a cylindrical extension 192 having an outwardly directed circumferential ring 194 formed thereon. Cylindrical section 190 extending from platform 184 has a corresponding inward facing circumferential bead 198. The inwardly directed bead 198 may be engaged over outwardly directed ring 194 such that shaft 182 may rotate relative to platform 184 while supporting takeup spool platform 184.

In this embodiment, platform 184 is not rigidly attached to side walls 166 or directly from upper wall 164 of casing 162. Instead, platform 184 is supported from casing 162 by way of its connection to shaft 182. Although platform 184 does not rotate relative to casing 162 because of the normal drive mechanism used to rotate shaft 182, the platform 184 is free to float as it is supported from casing 162 through shaft 182. The floating action of platform 184 substantially reduces possible binding between the bottom edge of the ribbon R and the platform 184. Similarly, because takeup shaft 182 is not supported for rotation between an upper and lower wall, but rather is supported solely from upper wall 164 for rotation therefrom, the likelihood of shaft 182 becoming bound up is greatly reduced.

Therefore, the present invention discloses preferred embodiments of a typewriter ribbon cartridge which eliminates many of the problems heretofore existing in those cartridges presently in use. Although preferred embodiments of the invention have been described in the foregoing detailed description and illustrated in the accompanying drawing, it will be understood that the invention is not limited to the embodiments disclosed, but is capable of numerous rearrangements, modifications and substitutions of parts and elements without departing from the spirit of the invention. The present invention is therefore intended to encompass such rearrangements, modifications and substitutions of parts and elements as fall within the scope of the appended claims.

What is claimed is:

1. A typewriter ribbon cartridge comprising:

an upper wall member, side walls extending downwardly from said upper wall member forming an area between the side walls and upper wall member, a ribbon takeup spindle having one end rotatively supported by said upper wall member, a cover attached to the side walls opposite said upper wall member and rotatively supporting the end of said ribbon takeup spindle opposite said upper wall member, said cover closing only a portion of the area beneath said upper wall member and said portion being adjacent said ribbon takeup spindle, a ribbon supply spool including a supply spool shaft and a ribbon supply spool platform attached to one end of said supply spool shaft, and means for rotatively supporting the end of said ribbon supply spool shaft opposite said ribbon supply spool platform from said upper wall member with said ribbon supply spool platform positioned beneath said upper wall member to substantially cover the area below said upper wall member not covered by said cover.

2. The typewriter ribbon cartridge of claim 1 wherein said means for rotatively supporting said ribbon supply spool from said upper wall member comprises:

a flared lip circumferentially formed on one end of said ribbon supply spool, and an opening in said upper wall member for receiving said flared lip therethrough, said opening having a circumference smaller than that of said flared lip such that said lip may be engaged through said opening and retained therethrough.

3. The typewriter ribbon cartridge of claim 1 wherein said means for rotatively supporting said ribbon supply spool from said upper wall member comprises:

an inwardly directed circumferential bead formed on one end of said ribbon supply spool, and a corresponding outwardly extending circumferential bead supported from said upper wall member, said outwardly directed bead having a circumference slightly larger at its outermost circumference than the circumference of said inwardly directed circumferential bead at its innermost circumference whereby said beads may be overlapped to retain said ribbon supply spool in rotative engagement with said upper wall member.

4. The typewriter ribbon cartridge according to claim 1 wherein said ribbon supply spool platform is in a plane common with the plane of said cover.

5. A typewriter ribbon cartridge comprising:

an upper wall member, a side wall extending downwardly from said upper wall member around substantially the entire perimeter of said upper wall member, a ribbon supply spool including a supply spool shaft for receiving ribbon therearound and a ribbon supply spool platform attached to one end of said supply spool shaft, means for rotatively supporting the end of said ribbon supply spool shaft opposite said ribbon supply spool platform from said upper wall member, a ribbon takeup spindle having one end rotatively supported by said upper wall member, and a cover attached to said wall at points opposite said upper wall member and rotatively supporting the end of said ribbon takeup spindle opposite said upper wall member, said cover extending only in the area of said ribbon takeup spindle and covering only a portion of the area beneath said upper wall member without overlying or underlying said ribbon supply spool platform.

6. The typewriter ribbon cartridge according to claim 5 wherein said ribbon supply spool platform is in a plane common with the plane of said cover.

7. A typewriter ribbon cartridge for receiving an inked ribbon therein, comprising:

an upper wall member, a side wall extending downwardly from said upper wall member around substantially the entire perimeter of said upper wall member forming an area between the side walls and upper wall member, a ribbon supply spool including a supply spool shaft for receiving ribbon thereon and only one ribbon supply spool platform, said ribbon supply spool platform being attached to one end of said supply spool shaft for supporting said ribbon, means for rotatively supporting the end of said ribbon supply spool shaft opposite said ribbon supply spool platform from said upper wall member, a ribbon takeup spindle having one end rotatively supported by said upper wall member, and a cover attached to the side wall opposite said upper wall member and rotatively supporting the end of said ribbon takeup spindle opposite said upper wall member, said cover closing only a portion of the area beneath said upper wall member with the remainder of the area below said upper wall member being substantially closed by said ribbon supply spool platform.

8. The typewriter ribbon cartridge according to claim 7 wherein said ribbon supply spool platform is in a plane common with the plane of said cover.

9. A typewriter ribbon cartridge comprising:

an upper wall, a side wall extending downwardly from said upper wall, a ribbon supply spool including a supply spool shaft for receiving a supply of ribbon wound thereon and a ribbon supply spool platform attached to one end of said supply spool shaft, for rotation with said supply spool shaft, means for rotatively supporting the end of said ribbon supply spool shaft opposite said ribbon supply spool platform from said upper wall, a ribbon takeup spindle for receiving ribbon from said ribbon supply spool and having one end rotatively supported by said upper wall at a point spaced from said means for rotatively supporting the end of said ribbon supply spool shaft from said upper wall, and a cover attached to said side wall opposite said upper wall and rotatively supporting the end of said takeup spindle opposite said upper wall, said cover not overlying or underlying said ribbon supply spool platform.

* * * * *